US006663419B2

(12) United States Patent
Vaden

(10) Patent No.: US 6,663,419 B2
(45) Date of Patent: Dec. 16, 2003

(54) REDUCED CROSSTALK MODULAR PLUG AND PATCH CORD INCORPORATING THE SAME

(75) Inventor: Sterling Vaden, Black Mountain, NC (US)

(73) Assignee: Superior Modular Products Incorporated, Swannanoa, NC (US)

( * ) Notice: Subject to any disclaimer, the term of this patent is extended or adjusted under 35 U.S.C. 154(b) by 0 days.

(21) Appl. No.: 10/325,160

(22) Filed: Dec. 19, 2002

(65) Prior Publication Data

US 2003/0104722 A1 Jun. 5, 2003

Related U.S. Application Data

(63) Continuation of application No. 09/866,081, filed on May 25, 2001, now Pat. No. 6,517,377.
(60) Provisional application No. 60/207,056, filed on May 25, 2000.

(51) Int. Cl.[7] ..... H01R 11/00
(52) U.S. Cl. ..... 439/502; 439/676; 439/941
(58) Field of Search ..... 439/502, 418, 439/941, 638, 676, 623

(56) References Cited

U.S. PATENT DOCUMENTS

| | | | | |
|---|---|---|---|---|
| 4,054,350 A | | 10/1977 | Hardesty | |
| 4,493,951 A | * | 1/1985 | Sanderson et al. | 439/676 |
| 5,310,363 A | | 5/1994 | Brownell et al. | |
| 5,326,284 A | | 7/1994 | Bohbot et al. | |
| 5,571,035 A | | 11/1996 | Ferrill | |
| 5,593,314 A | | 1/1997 | Lincoln | |
| 5,624,274 A | * | 4/1997 | Lin | 439/676 |
| 5,628,647 A | | 5/1997 | Rohrbaugh et al. | |
| 5,700,167 A | | 12/1997 | Pharney et al. | |
| 5,797,764 A | | 8/1998 | Coulombe et al. | |
| 6,083,052 A | | 7/2000 | Adams et al. | |
| 6,162,077 A | * | 12/2000 | Laes et al. | 439/941 |

* cited by examiner

*Primary Examiner*—Renee Luebke
*Assistant Examiner*—Felix O. Figueroa
(74) *Attorney, Agent, or Firm*—Carter Schnedler & Monteith, P.A.

(57) ABSTRACT

Patch cords suitable for Category 6 data transmission applications terminated at the two ends by first and second modular plugs that differ from each other in a complementary manner such that relative positioning of wire pairs is maintained at both ends of the patch cord, and without any crossing of any wire of one pair over a wire of another pair within either modular plug.

2 Claims, 7 Drawing Sheets

"A"

"B"

"A"

"B"

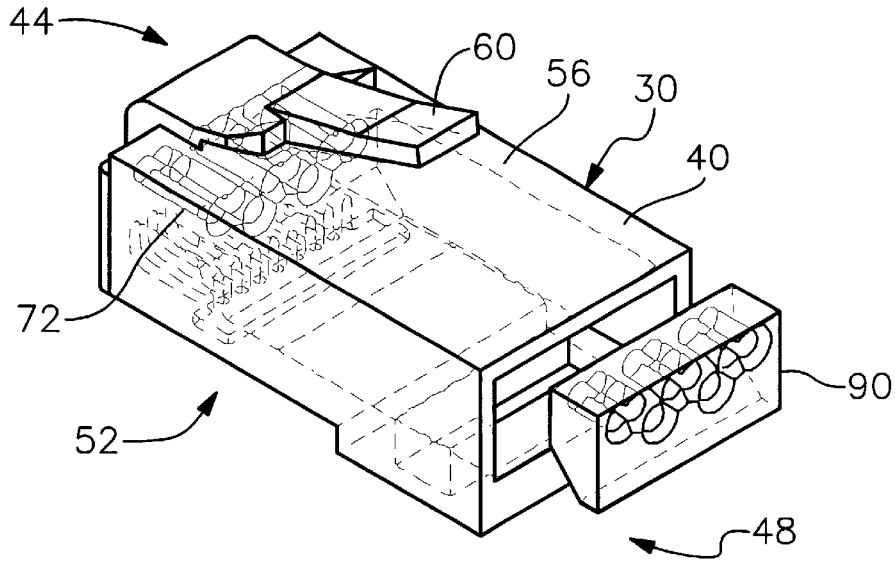
"B" Plug Fig. 4
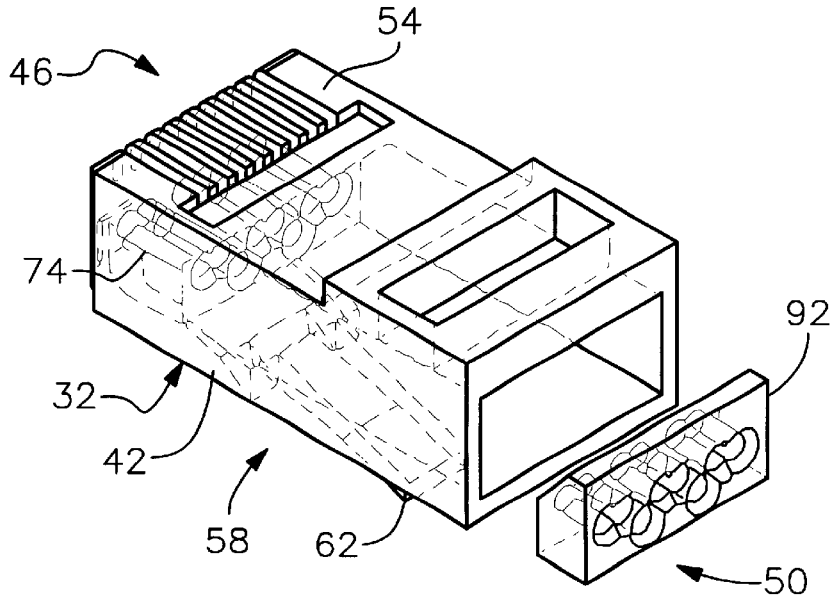
"A" Plug Fig. 5

"A"

"B"

REDUCED CROSSTALK MODULAR PLUG AND PATCH CORD INCORPORATING THE SAME

CROSS-REFERENCE TO RELATED PATENT APPLICATIONS

This is a continuation of U.S. patent application Ser. No. 09/866,081, now U.S. Pat. No. 6,517,377 filed May 25, 2001, which claims the benefit of U.S. Provisional Patent Application Ser. No. 60/207,056, filed May 25, 2000.

BACKGROUND OF THE INVENTION

The invention relates generally to electrical connector and cable assemblies and, more particularly, to patch cord assemblies comprising multi-conductor cable terminated by modular plugs at each end, as well as to the modular plugs themselves.

Modular plugs are well known and are extensively used in data communication networks, particularly local area networks. A typical patch cord comprises a length of cable including four twisted pair, insulated, multi-colored wires (eight in total) arranged in a bundle within a cable jacket. Category 5 connectors operate at frequencies of order 100 MHz, while maintaining 43 dB isolation between pairs. Category 6 products operate at frequencies of order 200 MHz, while maintaining 46 dB isolation between pairs.

Maintaining the performance at high frequencies of such networks employing twisted pair conductors and relatively simple modular plugs is difficult. Crosstalk resulting from capacitive and inductive coupling between the various signal pairs is problematic. In addition, minimizing discontinuities in characteristic impedance at the modular plug terminations is important in order to minimize reflected signals which manifest as wire pair return loss.

SUMMARY OF THE INVENTION

Embodiments of the invention, suitable for category 6 data transmission applications, achieve reduced capacitive coupling between wire pairs within modular plugs. In addition, wire pair return loss is improved, and is more uniform from one wire pair to the next.

In an exemplary embodiment of the invention, a patch cord includes a length of multi-conductor cable having first and second ends, and including eight wires organized as four pairs. First and second modular plugs terminate the first and second cable ends respectively. The first and second modular plugs differ from each other in a complementary manner such that relative positioning of the pairs is maintained at both ends of the patch cord.

BRIEF DESCRIPTION OF THE DRAWINGS

FIG. 4 is a partially exploded three-dimensional view generally from the rear of Plug "A" of FIGS. 1 and 2;

FIG. 5 is a similar partially exploded three-dimensional view generally from the rear of Plug "B" of FIGS. 1 and 3;

DETAILED DESCRIPTION

Figure 1:
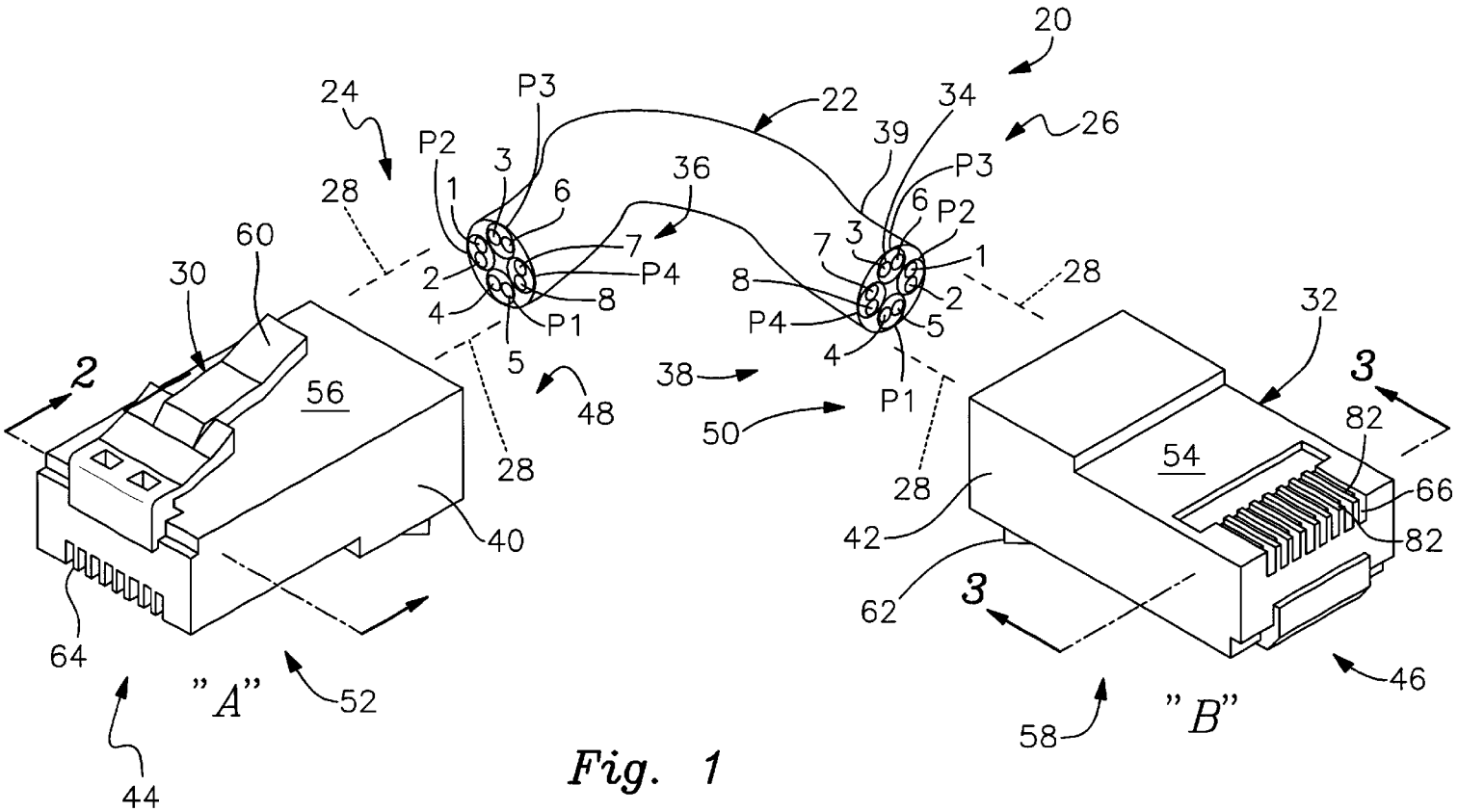
FIG. 1 depicts a patch cord embodying the invention, including two modular plugs designated "A" and "B" differing from each other in a complementary manner.
Figure 2:
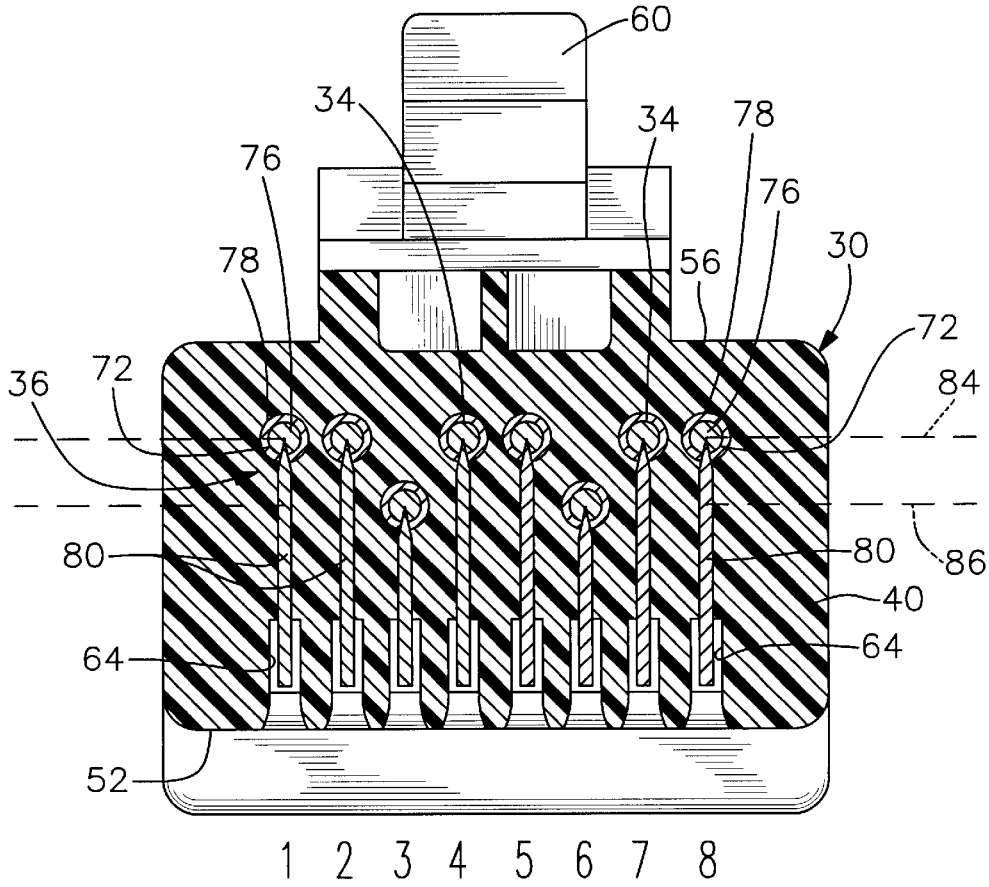
FIG. 2 is a transverse cross sectional view of one of the complementary modular plugs, Plug "A," taken on line 2—2 of FIG. 1.
Figure 3:
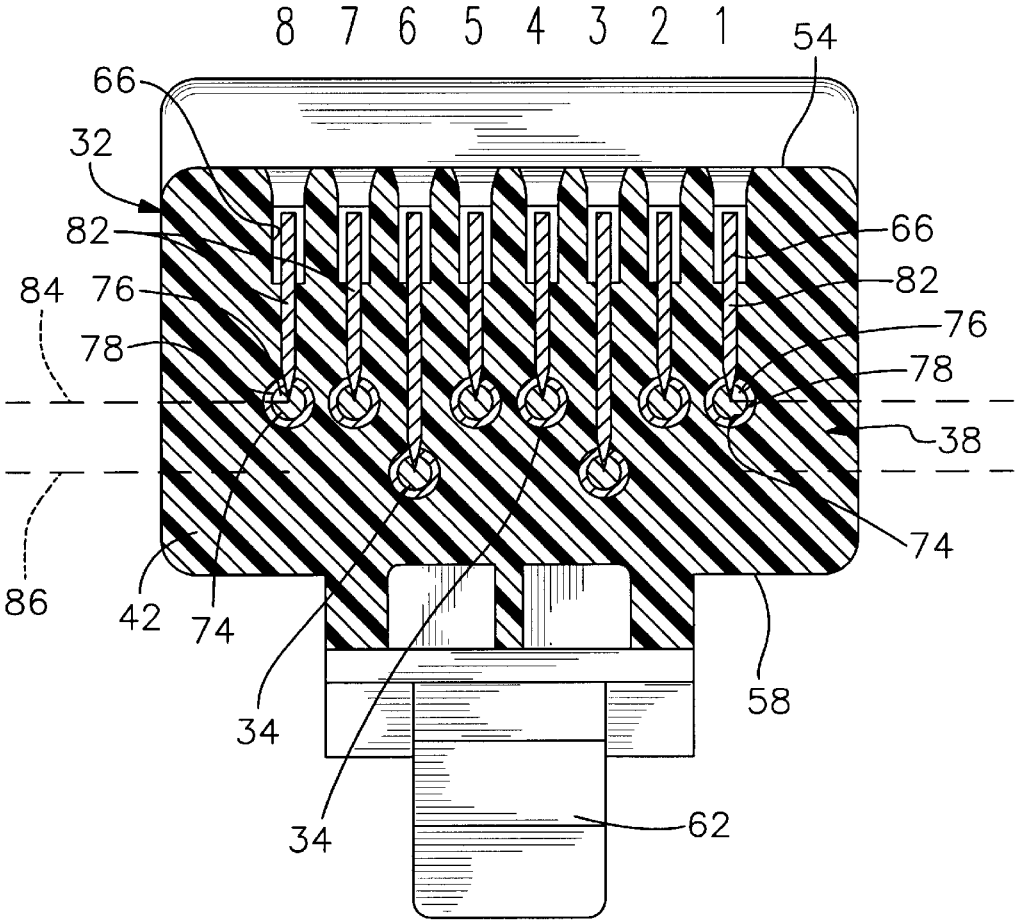
FIG. 3 is a transverse cross sectional view of the other of the complementary modular plugs, Plug "B," taken on line 3—3 of FIG. 1.

Referring first to FIGS. 1, 2 and 3, a Category 6 patch cord 20 embodying the invention includes a length of multi-conductor cable 22 having first and second ends 24 and 26. For convenience of illustration, the ends 24 and 26 are schematically depicted in cross section, with dash lines representing continuation into respective terminating modular plugs 30 and 32. As is described in detail hereinbelow, the modular plugs 30 and 32 differ from each other in a complementary manner, and for purposes of description are also referred to herein as Plug "A" and Plug "B," respectively.

As is well known, the cable 22 is a twisted pair cable wherein selected pairs of wires 34 are twisted together, the wires 34 having first and second ends 36 and 38 corresponding to the first and second ends 24 and 26 of the cable 22. The cable 22 has four twisted pairs of insulated wires (eight wires in total) organized as four twisted Pairs P1, P2, P3 and P4 within a cable jacket 39. A conventional pairing arrangement of wires for termination by the modular plugs 30 and 32 is 1–2 (Pair P2 in the exemplary embodiment); 3–6 (Pair P3 in the exemplary embodiment); 4–5 (Pair P1 in the exemplary embodiment); and 7–8 (Pair P4 in the exemplary embodiment).

The modular plugs 30 and 32 (Plug "A" and Plug "B") are of similar construction, but differ from each other in a complementary manner, in particular in the arrangement of passages receiving the wire ends 36 and 38.

Thus, referring in addition to FIGS. 4 and 5, as well as to FIGS. 1–3, the modular plugs 30 and 32 include respective dielectric housings 40 and 42, of transparent plastic. The plugs 30 and 32 have respective closed forward ends 44 and 46, and respective cable-receiving rearward ends 48 and 50. In addition, the dielectric housings 40 and 42 have respective terminal sides 52 and 54, as well as respective tab sides 56 and 58 from which conventional retention tabs 60 and 62, respectively, extend for retaining the respective plugs 30 and 32 in mating sockets (not shown) comprising, for example, part of a patch panel (not shown).

Opening on to the terminal side 52 of the dielectric housing 40 of Plug "A" are eight parallel and evenly laterally spaced contact-receiving slots 64, defining, in sequential order, position numbers 1, 2, 3, 4, 5, 6, 7 and 8. Likewise, opening on to the terminal side 54 of the dielectric housing 42 of Plug "B" are a set of eight contact-receiving slots 66 likewise defining, in sequential order, position numbers 1, 2, 3, 4, 5, 6, 7, and 8.

Conventionally, position numbers 1 and 2 correspond to one pair, such as Pair P2 or Pair P4. Position numbers 7 and 8 correspond to another pair, such as Pair P4 or Pair P2. Position numbers 4 and 5 correspond to yet another pair, such as Pair P1. Position numbers 3 and 6 correspond to still another pair, such as Pair P3.

Within the dielectric housing 40 comprising Plug "A" is a set 72 of eight wire-receiving passages in communication with respective ones of the contact-receiving slots 64. Likewise, within the dielectric housing 42 comprising Plug "B" is a set 74 of eight wire-receiving passages in communication with respective ones of the contact-receiving slots 66.

As best seen in FIGS. 2 and 3, the first and second ends 36 and 38 of the cable wires 34 are received in respective ones of the wire-receiving passages of the sets 72 and 74 within the respective modular plugs 30 and 32. The wires 34 comprise conductors 76 surrounded by insulation 78.

The modular plug 30 (Plug "A") includes a set 80 of eight contacts received within the contact-receiving slots 64, facing and opening on to the terminal side 52. The contacts of the set 80 electrically engage respective ones of the cable wire ends 36 in a conventional insulation-displacement contact (IDC) manner upon assembly of the patch cord 20. Likewise, the modular plug 32 (Plug "B") includes a set 82 of eight contacts received within the contact-receiving slots 66 facing and opening on to the terminal side 54. The contacts of the set 82 electrically engage respective ones of the cable wire ends 38 in a conventional insulation-displacement contact (IDC) manner.

The manner in which the modular plugs 30 and 32 differ from each other in a complementary manner is shown in FIGS. 2 and 3 (as well as in FIGS. 4 and 5). In particular, the arrangements of the sets 72 and 74 of wire-receiving passages differ. With particular reference to FIG. 3, within the modular plug 32 (Plug "B"), two of the wire-receiving passages 74 in communication with the slots 66 defining position numbers 3 and 6 are offset from the remaining wire-receiving passages 74 in a direction relatively farther from the terminal side 54 of the dielectric housing 42. In a complementary manner, and with particular reference to FIG. 2, within the modular plug 30 (Plug "A"), two of the wire-receiving passages 72 in communication with the slots 64 defining position numbers 3 and 6 are offset from the remaining wire-receiving passages 72 in a direction relatively closer to the terminal side 52 of the dielectric housing 40.

More particularly, in the exemplary embodiment, within each of the modular plugs 30 and 32 (Plug "A" and Plug "B") six of the wire-receiving passages 72 (Plug "A") and 74 (Plug "B") defining position numbers 1, 2, 4, 5, 7 and 8 are disposed in a first plane 84, and two of the wire-receiving passages 72 (Plug "A") and 74 (Plug "B") are disposed in a second plane 86 offset from the first plane 84. The two planes 84 and 86 are spaced one above the other. One of the two planes 84 and 86 is relatively closer to the terminal side 52 or 54 of the dielectric housing 40 or 42, and the other of the two planes 84 and 86 is relatively farther from the terminal side 52 or 54 of the dielectric housing 40 or 42.

Thus, within the modular plug 32 of FIG. 3 (Plug "B"), the first plane 84 is relatively closer to the terminal side 54 of the dielectric housing 42 and the second plane 86 is relatively farther from the terminal side 54 of the dielectric housing 42. Within the modular plug 30 of FIG. 2 (Plug "A"), the second plane 86 is relatively closer to the terminal side 52 of the dielectric housing 40, and the first plane 84 is relatively farther from the terminal side 52 of the dielectric housing 40.

As may be seen in FIGS. 4 and 5, the plugs 30 and 32 have respective wire-guiding inserts 90 and 92 having apertures corresponding to the arrangement of the respective sets of wire-receiving passages 72 and 74. In the exploded views of FIGS. 4 and 5 the inserts 90 and 92 are positioned adjacent the cable-receiving rearward ends 48 and 50. However, upon assembly of the patch cord 20, the inserts 90 and 92 are positioned near the respective forward ends 44 and 46 of the plugs 30 and 32, leaving spaces near the rearward ends 48 and 50 for a cable-retaining filler (not shown) or a strain-relief insert (not shown).

Figure 6:
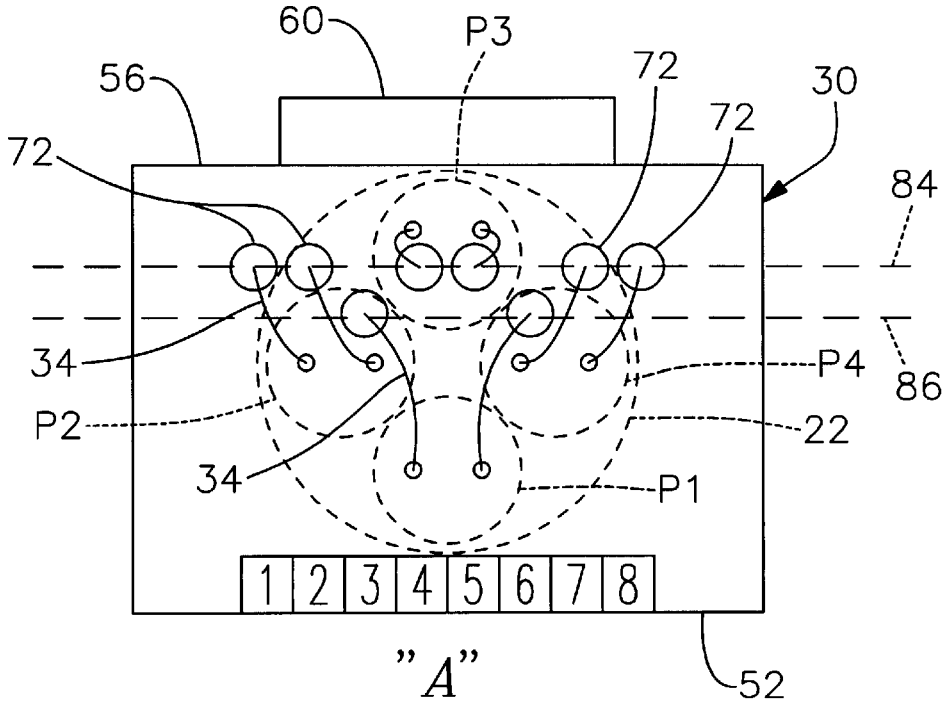
FIG. 6 is a highly schematic representation of the arrangement of wires within Plug "A" of FIGS. 1, 2 and 4.
Figure 7:
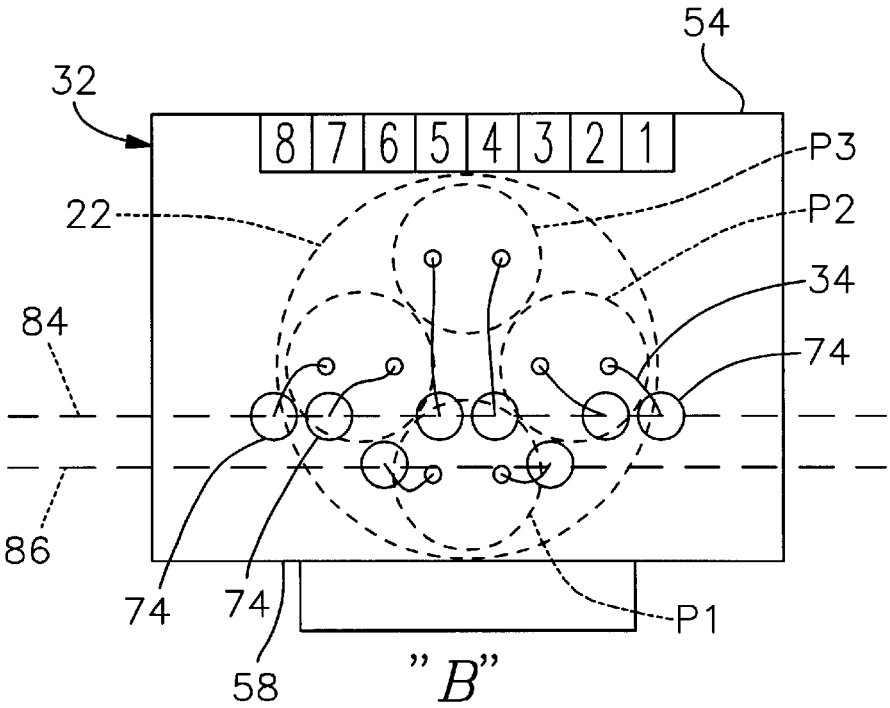
FIG. 7 is a complementary highly schematic representation of the arrangement of wires within Plug "B" of FIGS. 1, 3 and 5.

FIGS. 6 and 7 are respective highly schematic depictions, viewed generally from the forward ends 44 and 46, representing the manner in which the eight individual wires of the multi-conductor cable arranged in Pairs P1, P2, P3 and P4 are routed within the plugs 30 and 32 from the points where the cable jacket 39 is stripped away to the corresponding wire-receiving passages 72 of the modular plug 30 (Plug "A") and to the corresponding wire-receiving passages 74 of the modular plug 32 (Plug "B").

From FIGS. 6 and 7, it may be seen that the relative positioning of the wire pairs P1, P2, P3 and P4 is maintained at both ends of the patch cord 20. In particular, the orientation of the wire-receiving passages 72 and 74 is the same relative to the wire positions at the two ends 24 and 26 of the cable 22. Moreover, no wire of any one pair is required to cross over any wire of another pair within either one of the modular plugs 30 and 32. The offset of the wire-receiving passages 72 (Plug "A") and 74 (Plug "B") allows the conductors of each of the Pairs P1, P2, P3 and P4 to remain paired as much as possible to maintain characteristic impedance so as to improve return loss characteristics. In addition the wires are separated as pairs from other pairs as much as possible to reduce crosstalk couplings.

The following TABLE captioned "Category 6 Plug L and C Values" compares de-embedded near-end crosstalk of Plugs A and B for each of the six possible pair combinations. The table is based on measured results from thirty samples of each part; thus, calculated values for the average and standard deviation are given. Magnitude and phase are compared separately.

TABLE

Category 6 plug L and C values
Crosstalk Comparison of "Plug A" and "Plug B" for each pair combination
Data Based on 30 Samples

| | | Pair Combination: | | | | | |
|---|---|---|---|---|---|---|---|
| | | P1-P2 | P1-P3 | P1-P4 | P2-P3 | P2-P4 | P3-P4 |
| | | (Position numbers:) | | | | | |
| Plug A | | 45-12 | 45-36 | 45-78 | 12-36 | 12-78 | 36-78 |
| Mag, dB: | Average | −58.93 | −37.43 | −60.07 | −48.32 | −80.58 | −46.24 |
| | Std. Dev. | 4.75 | 0.48 | 3.92 | 2.49 | 6.91 | 1.71 |

TABLE-continued

| Category 6 plug L and C values<br>Crosstalk Comparison of "Plug A" and "Plug B" for each pair combination<br>Data Based on 30 Samples | | | | | | | |
|---|---|---|---|---|---|---|---|
| | | Pair Combination: | | | | | |
| | | P1-P2 | P1-P3 | P1-P4 | P2-P3 | P2-P4 | P3-P4 |
| | | (Position numbers:) | | | | | |
| | | 45-12 | 45-36 | 45-78 | 12-36 | 12-78 | 36-78 |
| Plug B | | | | | | | |
| Mag, dB: | Average | −64.16 | −37.57 | 60.79 | −46.33 | −79.65 | −47.79 |
| | Std. Dev. | 5.73 | 0.47 | 6.33 | 1.28 | 6.49 | 2.10 |
| Plug A: | | | | | | | |
| Phase: | Average | 91.24 | −89.58 | 89.17 | −89.09 | −56.08 | −89.66 |
| | Std. Dev. | 2.14 | 0.13 | 3.23 | 1.02 | 52.43 | 1.10 |
| Plug B: | | | | | | | |
| Phase: | Average | 91.61 | −89.34 | 94.50 | −88.83 | −55.12 | −89.33 |
| | Std. Dev. | 3.28 | 0.13 | 2.15 | 0.72 | 69.87 | 1.06 |

Figure 8:
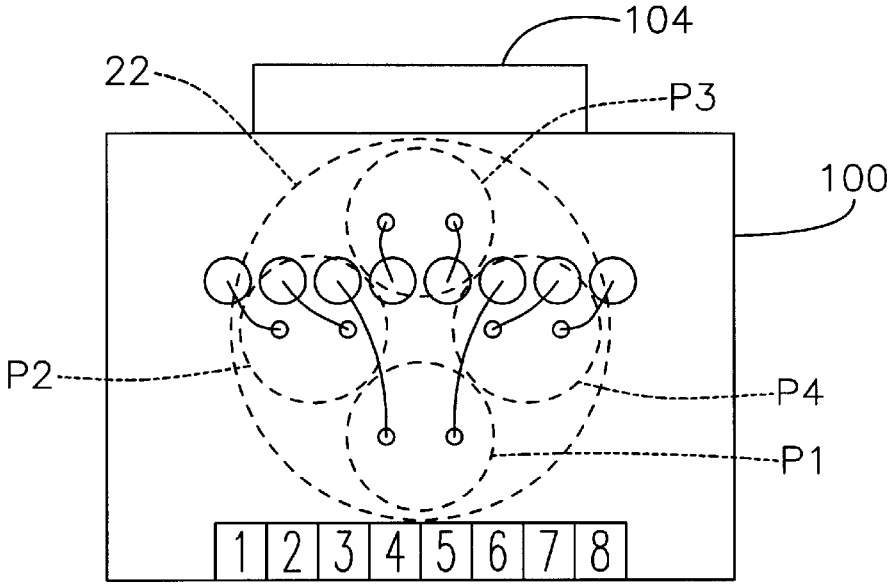
Fig. 8 Prior Art
FIGS. 8 and 9, which may be contrasted with FIGS. 6 and 7, respectively, represent an arrangement of wires within a pair of prior art modular plugs terminating the ends of a prior art patch cable.
Figure 9:
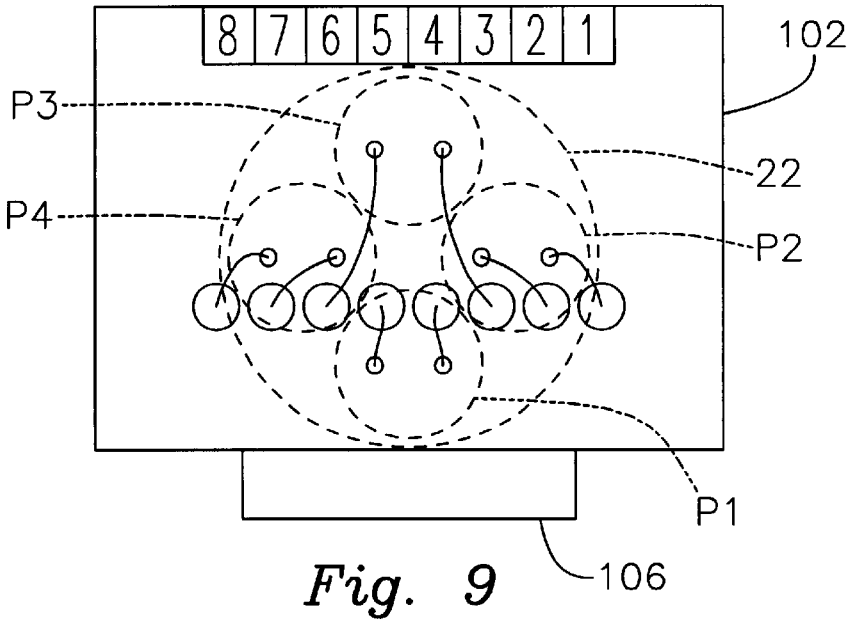
Fig. 9 Prior Art

FIGS. 8 and 9 may be contrasted to FIGS. 6 and 7, and depict in generally the same manner the routing of wires within the modular plugs 100 and 102 of a conventional prior art patch cord. Although the plug 100 of FIG. 8 is oriented with its tab 104 up, and the plug of FIG. 9 is oriented with its tab 100 down, the plugs 100 and 102 themselves are identical.

In the plug 100 of FIG. 8, the wires of Pair P1 must extend between the wires of Pairs P2 and P4 to reach the wire-receiving passages corresponding to terminal positions 4 and 5. At the other end, within the plug 102 of FIG. 9, the wires of Pair P3 must extend between the wires of Pairs P2 and P4 to reach the wire-receiving passages corresponding to positions 3 and 6.

As a result, in the prior art arrangement depicted in FIGS. 8 and 9, the two ends of the cable have different characteristic couplings between Pairs 1–2, 1–4 and 2–3, 3–4. In addition, having all wires parallel in the same plane in the fixed portion of the plug (wire guide and wire-receiving passages) results in greater than desired coupling magnitude, particularly for a category 6 application requirement.

Figure 10:
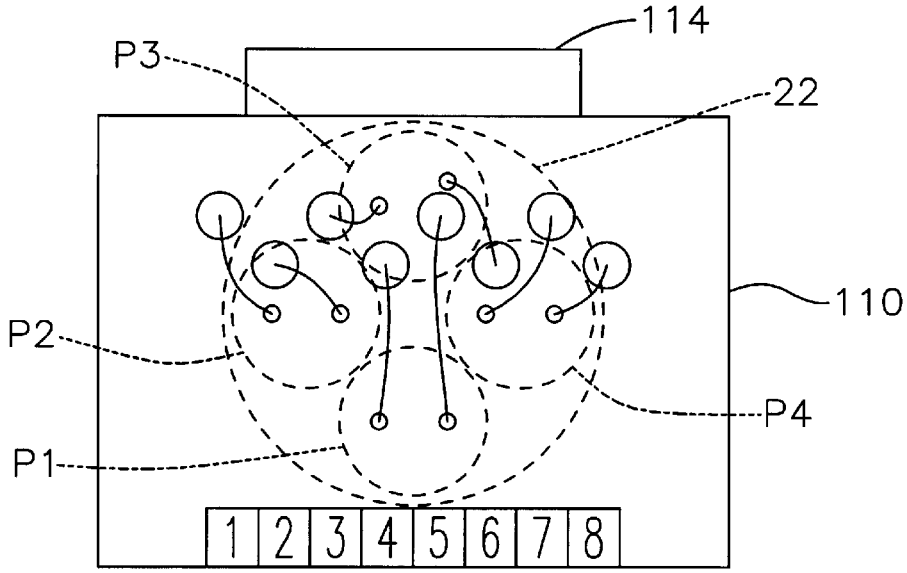
Fig. 10 Prior Art
FIGS. 10 and 11, which likewise may be contrasted with FIGS. 6 and 7, respectively, represent an arrangement of wires within another form of prior art modular plugs terminating the ends of another prior art patch cable.
Figure 11:
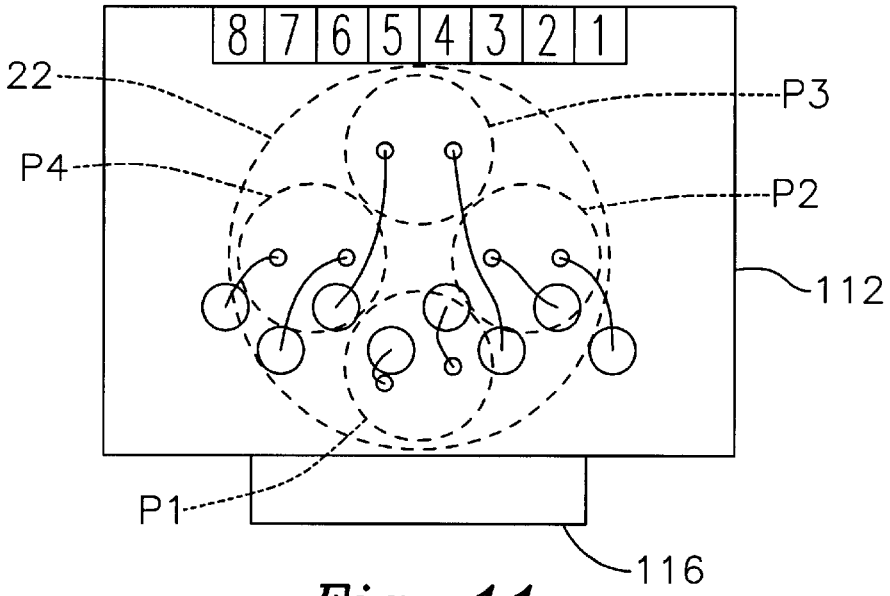
Fig. 11 Prior Art

FIGS. 10 and 11 depict modular plugs 110 and 112 of another prior art patch cord. Within the modular plugs 110 and 112, the wire-receiving passages are arranged in a staggered pattern. Although the plug 110 at end "A" in FIG. 10 is oriented with its tab 114 up and the plug 112 at end "B" of FIG. 11 is oriented with its tab 116 down, the plugs 110 and 112 of FIGS. 10 and 11 are themselves essentially identical.

In FIG. 10, at end "A" within plug 110 the wires of Pair P1 extend between the wires of Pairs P2 and P4. Moreover, one wire of Pair P1 must cross over a wire of Pair P3 in order to reach the corresponding wire-receiving passage.

As shown in FIG. 11, at end "B", the wires of Pair P3 extend between Pairs P2 and P4, and one wire of Pair P3 crosses over Pair P1 to reach the corresponding wire-receiving passage.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A patch cord comprising:

a length of multi-conductor cable having first and second ends and including eight wires organized as four pairs; and first and second modular plugs terminating said first and second cable ends, respectively, said first and second plugs differing from each other in a complementary manner such that relative positioning of the pairs is maintained at both ends of said patch cord.

2. The patch cord of claim 1, wherein relative positioning of the pairs is maintained at both ends of said patch cord without any crossing of any wire of one pair over a wire of another pair within either modular plug.

* * * * *